United States Patent [19]

Salganik

[11] Patent Number: 4,852,506

[45] Date of Patent: Aug. 1, 1989

[54] MULTI-NEEDLE WALKING-FOOT CHAIN STITCH SEWING MACHINE

[76] Inventor: Felix Salganik, 4408 10th Ave., Apt. 3A, Brooklyn, N.Y. 11219

[21] Appl. No.: 197,665

[22] Filed: May 23, 1988

[51] Int. Cl.[4] ..... D05B 3/02; D05B 25/00; D05B 27/02; D05B 1/10

[52] U.S. Cl. ..... 112/220; 112/155; 112/197; 112/275

[58] Field of Search ..... 112/165, 166, 197, 155, 112/221, 117, 164, 163, 80.23, 121.23, 275, 220

[56] References Cited

U.S. PATENT DOCUMENTS

| | | | |
|---|---|---|---|
| 3,247,813 | 4/1966 | Hart et al. | 112/163 |
| 3,463,102 | 8/1969 | Eklund | 112/117 |
| 3,847,100 | 11/1974 | Garron | 112/221 |
| 4,006,696 | 2/1977 | Robertson | 112/117 |
| 4,380,203 | 4/1983 | Bianchi | 112/275 |
| 4,470,360 | 9/1984 | Gerlach | 112/117 |
| 4,580,515 | 4/1986 | Shinoda | 112/163 |
| 4,641,591 | 2/1987 | Draghicchio | 112/155 |

*Primary Examiner*—Andrew M. Falik
*Attorney, Agent, or Firm*—William T. Hough

[57] ABSTRACT

A walking needle chain stitch sewing machine having multi sewing heads laterally spaced apart from one-another, that includes upper primary drive shaft and secondary lower first and second drive shafts and mechanisms thereof for driving first and second needle-drive mechanisms, and that further includes other secondary lower third and fourth drive shafts and mechanisms thereof for driving first and second feed-dogs and mechanisms thereof, with the first and second drive shafts being connected to the primary drive shaft by respectively spaced-apart drive-belts each mounted between driving and driven gears, and with the third and fourth drive shafts likewise being connected to the primary drive shaft by respectively spaced-apart other drive-belts each mounted between other driving and driven gears. Each of the sewing heads additionally includes reciprocatable sewing needle(s) reciprocatable in each of upwardly-downwardly movement directions and forwardly-rearwardly movement directions, and forwardly-rearwardly reciprocatable feed-dog(s), and synchonizing structures and mechanisms thereof. Each of the needle mechanisms and each of the feed-dog structures and mechanisms thereof are connected to its respective secondary drive shaft through and driven by a synchronizer structure and mechanism thereof that has its own separate solenoid lock therefor separately activateable and deactivatable for and during intermittently locking against revolving movement during synchronization of needle reciprocation with feed-dog reciprocation. Also there is an alarm mechanism activating a sensory-detectable alarm whenever one or more locks associated with the synchronizing mechanism(s) fails to engage.

4 Claims, 1 Drawing Sheet

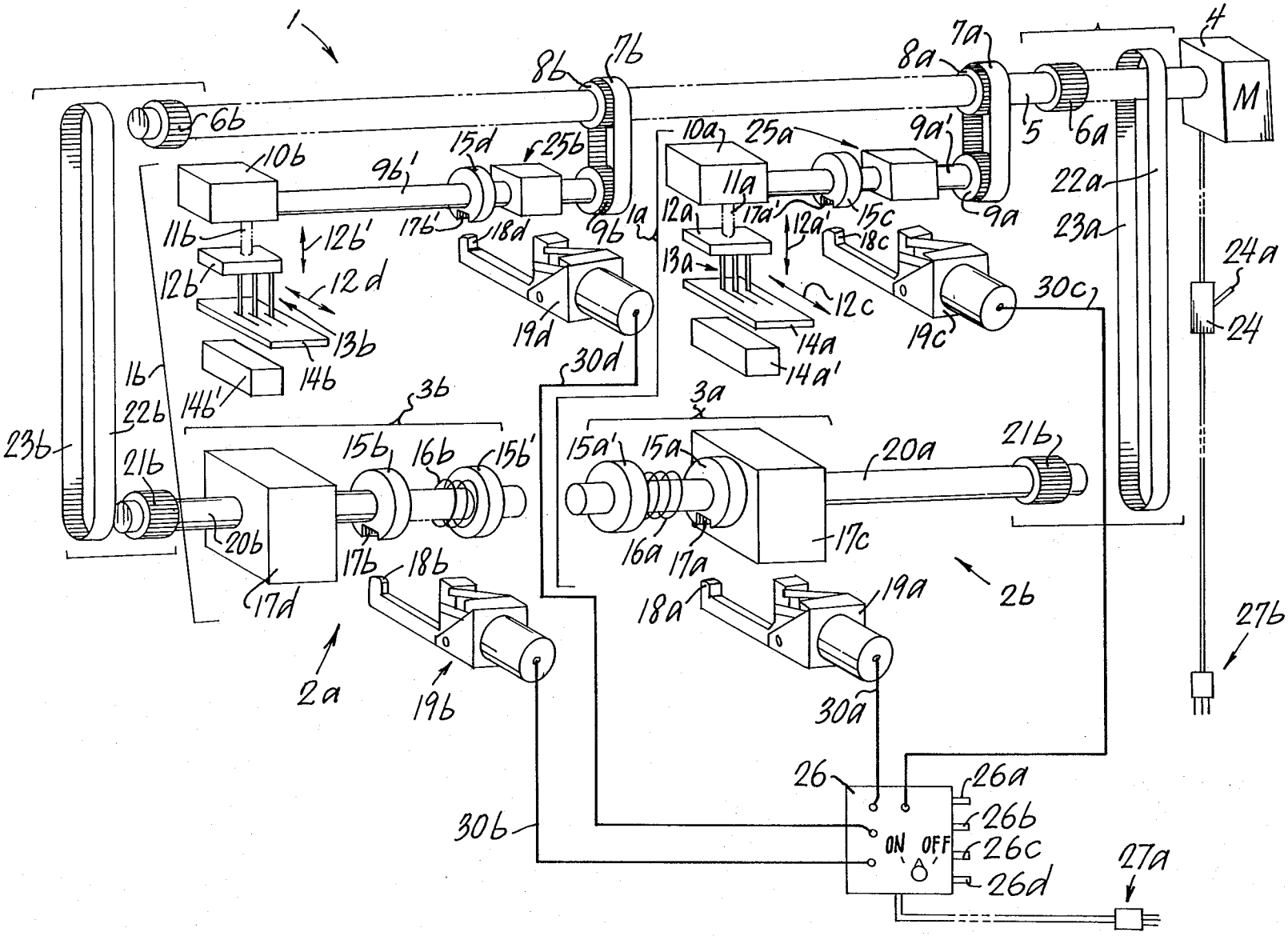
M
4
24a
24
27b
27a
6a
22a
23a
5
7a
8a
9a
9a'
30c
19c
18c
15c
12c
12a'
14a
14a'
25a
11a
17a'
10a
12a
13a
1a
21b
20a
17c
19a
30a
26
26a
26b
26c
26d
OFF
ON
3a
15a
16a
17a
18a
15a'
7b
8b
9b
25b
30d
19d
18d
15d
17b'
9b'
12b'
12d
13b
14b
10b
11b
12b
14b'
6b
1b
22b
23b
15b'
16b
15b
17b
18b
19b
30b
3b
2a
17d
20b

MULTI-NEEDLE WALKING-FOOT CHAIN STITCH SEWING MACHINE

STATEMENT OF PRIOR ART

This invention relates to improvements in a walking needle chain stitch sewing machine, directed to obtaining a commercially feasible machine.

While a novelty patentability search produced no relevant art, in so far as a walking needle chain stitch sewing machine with both upwardly-downwardly and forwardly-backwardly reciprocating needles synchronized with forwardly-backwardly reciprocating feed-dogs, and therefore located prior art had no relevance to critical synchronization found to be essential to avoid shearing of drive shafts for the multihead present inventive sewing machine, prior art patents include as follow.

Hart et al. U.S. Pat. No. 3,247,813, directed to a multi-position needles-machine for sewing-together several parts in the making of air filters. As above-noted, this is not a walking-needle chain stitch machine having forwardly-rearwardly reciprocating needle(s) nor any synchronized forwardly-rearwardly reciprocating feed-dogs, thus not confronted with synchronizing stresses and problems above-noted. Accordingly, the employment of spaced-apart driving belts between upper and lower shafts is optional in this prior art patent, as a mere matter of choice, not related to problems of the present invention.

Each of the Gerlach U.S. Pat. No. 4,470,360 and Robertson U.S. Pat. No. 4,006,696 relate to multi-position quilting-type sewing machines, likewise devoid of forwardly-reciprocating needles and forwardly-rearwardly reciprocating feed-dogs, and accordingly likewise devoid of the present inventions critical problems associated with synchronization, whereby again this prior art also merely optionally utilizes spaced-apart drive belts.

Garron U.S. Pat. No. 3,847,100 represents a typical single-chain drive for a multi-position skip-stitch sewing machine devoid of synchronized feed dogs and needles, the action and movement being divrgent from that of the present invention, and accordingly this patent is able to utilize a single-chain drive devoid of problems confronted by the present invention. Likewise, Eklund U.S. Pat. No. 3,463,102 of a totally divergent and different function and action, utilizes single drive type force-chain, not confronted with problems associated with the present invention.

BACKGROUND

Prior to the present invention, there has never existed any satisfactorily-operative multipositioned laterally-spaced sewing machine heads having multiple side-by-side needles thereof reciprocating both in upwardly-downwardly and forwardly-rearwardly directions in synchronization with associated spaced-apart feed-dogs reciprocating forwardly-backwardly directions in essential synchronization where needle and/or feed-dog drive shafts exceeded about sixteen to twenty inches. Because of the complex and involved above-described reciprocable motions of the needles and feed-dogs such a sewing machine, synchronization is essential to avoid the jamming and/or breaking of needles and/or feed-dogs and/or driving mechanism. In the inventor's efforts to enlarge this type machine to a multi-sewing heads machine having a plurality of laterally spaced-apart sewing-heads positions, the synchronization problems were further accentuated and magnified, with much greater stresses and occurances of loss of synchronizations. Upon loss of significant synchronization between the reciprocation of the needles and the feed dogs, in their respective reciprocal movements, stresses rapidly increase to a point at which the drive shaft(s) actually shear-off or break, together with associated jamming or breaking of needle(s) and/or feed-dogs. Even when problems are minor, and/or timely-corrected, the shut-down time is long and costly, as well as operating time between problems being severely limited. Accordingly, it was found that it was impossible to effectively obtain a satisfactorily operable machine utilizing a single-drive chain of force.

OBJECTS OF THE INVENTION

Accordingly, objects of the present invention include the obtaining of an operable multi sewing-head stitch sewing-machine having synchronized reciprocations of multiple-needles and corresponding multi-feed-dogs, where feed-dog drive shaft(s) have gauges of at-least about twenty inches of more.

Another object is to obtain a sewing machine above-noted, having improved retention of synchronization.

Another object is to obtain a sewing machine above-noted, having improved mechanisms for synchronization.

Another object is to obtain a sewing machine above-noted, with alarm capabilities indicative of problems during correction of synchronization.

Other objects become apparent from the preceding and following disclosure.

Preceding objects are obtained by the present invention, as described herein below.

SUMMARY OF THE INVENTION

Broadly the invention may be described as an improvement to a previously existing sewing machine conventionally known as a multi-needle chain stitch sewing machine with sewing heads that include alternating presser feet, synchronized reciprocatable needles and feed-dogs, all commonly driven by a single drive mechanism or single chain-of-drive. The improvement arises from overcoming problems arising during efforts to produce a similar type sewing machine but with multiple sewing heads, thereby with an effective length (series of each of side-by-side needles and side-by-side feed-dogs, or virtually unlimited lengths, normally gauge(s) os about twenty to twenty-four inches. More particularly, as noted in the preceding background discussion, prior utilization of a single drive with this type of sewing machine for a single sewing head, had always heretofore proven to be totally adequate. However, for the same arrangement, efforts to add additional heads resulted in major problems of jamming of needles and/or feed-dogs and of shearing-off of drive-shafts because of jamming-tendencies causing excessive stress on reciprocating feed-dogs. Incurred stresses progressed rapidly to a resulting major loss of synchronization and associated problems of jamming and shaft-shearing. Even though major efforts were made to make adjustments and various corrective modifications of the drive, the problem of frequent and rapid progressing toward loss of synchronization appeared to be unavoidable when additional sewing heads were added. Eventually the inventor conceived the concept of preventing lag or preventing lost motion by parallel drives, by critically providing a separate drive for each and to each separate sewing head's feed-dog(s). In so-doing, the inventor also likewise critically provided a separate synchronizing mechanism for each separate feed head for critically each feed-dog drive, and for more-preferably also each needle-drive. Such is in contrast to a single-drive feed-dog for multiple sewing heads being provided with a conventional prior-art single synchronizing mechanism that is/are inoperative when the single feed-dog drive shaft exceeds a maximum guage of about 20 inches. For the present improved invention, while the respective drive shafts for the feed-dogs still are individually limited in their maximum effective lengths for reasons discussed-above for the prior art machines, the cumulative effect by the present invention permits a series of side-by-side needles i.e., (multi-needles) extend to any desired practical lengths, typically about 24 inches or more.

In a preferred embodiment, instituting this conception as above-described in making of operating machines, it was discovered that by critically having parallel spaced-apart belts extending between a first drive shaft that directly drives the reciprocating needle(s) of all sewing heads and a second drive shaft that drives directly the reciprocating feed-dogs, loss of synchronization resulting from lag or lost-motion is reduced to a major extent obviating any significant threat of shearing of drive shaft(s), as well as substantially reducing propensity for and the frequency of required shut-downs for resynchronizing of the respective paired-mechanisms for needle reciprocation and for feed-dog reciprocation for each sewing head (generically speaking).

Also, in another preferred embodiment, by having the preferred separate synchronizing mechanism for each reciprocating needle(s) per sewing-head, enhanced accuracy and precision in synchronizing was easily achievable.

In another preferred embodiment, further reducing time requirements and adding efficiency of operation, preferably there is a common synchronization activation switching mechanism for concurrent and simultaneous activation and operation of all of the several synchronization mechanisms. In a further preferred embodiment thereof, when activating synchronization, reduced shut-down time is avoided by a preferred solenoid-activable mechanisms and associated locks positioned in operational positions for activation (turning-on) into activation locking-on, into synchronizing mechanism; such arrangement proved to be desirable and was achieved, resulting in improved operation, avoiding repetitive procedures and non-productive expensive delays.

However, occasionally with the multiple needle positions and multiple feed-dog positions to be synchronized, one or more lock-in mechanism failed to function properly, thereby thwarting synchronizing operational mechanisms and raising the possibilities of jamming and breaking of parts at the time of synchronization initiation. Accordingly, in another preferred embodiment, a separate sensor mechanism is attached to each solenoid and lock mechanism for each needle position and for each feed-dog position, ascertainable of whether or not one or more of the synchronizing mechanisms do or do not properly lock-on when turned-on to lock-on; preferably for each synchronization mechanism separately that accidentally fails to lock-in, such failure(s) result(s) in an alarm being initiated automatically for that particular position. The alarm is preferably of a type detectable by human senses, such as a flashing light and/or a bell and/or buzzer, for the position not locked-in.

As heretofore noted, it was further found that operation required non-only dual separate driving chains of force, but that preferred results were achieved by having preferred upper and lower shafts drivably connected by spaced-apart drive-belts (or chains), preferably having preferred gear-engaging teeth.

The invention may be better understood by making reference to the following illustrative FIGURE.

THE FIGURE

The FIGURE diagrammatically and symbolically illustrates the above-described invention in preferred embodiments thereof, in a front top and side perspective diagrammatic view.

DETAILED DESCRIPTION

For elements having common function for common parts, similar indicia are utilized for purposes of improved clarity and understanding. Once described, related indicia will not be described, except in some cases to add clarity and understanding.

For the present novel walking needle chain stitch machine 1 with alternating presser foot, with a plurality of spaced-apart also alternating sewing heads 1*a* and 1*b* with the needles 13*a* and 13*b* reciprocating both horizontally forwardly and rearwardly-extending and upwardly and downwardly-extending planes of movement in synchronization with the forwardly-rearwardly alternating presser feet 14*a* and 14*b*, the spaced-apart sewing heads 1*a* and 1*b* are driven by motor 4. The motor 4 drives the main shaft 5 that has spaced-apart drive gears 6*a* and 6*b* on which the spaced-apart drive belts 22*a* and 22*b* which by their respective toothed engaging surfaces 23*a* and 23*b* drive respective gears 21*a* and 21*b* mounted on the separate secondary lower drive shafts 20*a* and 20*b*. The first sewing head is driven by the gear 8*a*, driving belt 7*a* that drives gear 9*a* that is mounted on and drives shaft 9*a*'. The conventional needle reciprocating mechanism is symbolically designated unit 10*a*, driving the needle-lock unit 12*a* mounted on the reciprocating shaft 11*a*, the needle-lock units 12*a* carrying the above-noted needles 13*a*. The needle-lock units 12*a* and 12*b* respectively are mounted on mounting shafts 11*a* and 11*b* respectively, connected to and extending downwardly from needle-reciprocating mechanisms 10*a* and 10*b* respectively. The needles reciprocate in alternate directions along directional lines 12*a*' and 12*b*' upwardly and downwardly and in alternate forward-backward directions 12*c* and 12*d* substantially horizontally. Likewise the feed-dogs all reciprocated forwardly and rearwardly along directions 12*c* and 12*d*. Other conventional mechanism associated with and including the reciprocating dog(s) are symbolically represented by units 14*a*' and 14*b*' respectively that work in conventional operative relationships with synchronizing driving eccentric wheel 15*a*' and 15*b*' respectively, each of which that is synchronized by the synchronizing wheels 15*a* and 15*b* respectively. There are corresponding conventional units having such eccentric wheels as a part thereof symbolically represented as units 25*a* and 25*b* associated with the upper shaft 9*a*' and 9*b*'—which symbolic units correspond to the more detailed illustrated conventional combinations 3*a* and 3*b* associated with the lower shafts 20*a* and 20*b*. The synchronizing wheel 15*a* has lock-slot 17*a* receivable of lock-key 18*a* of conventional selenoid mechanism 19a. Between the eccentric wheel 15a' and the synchronizing wheel 15a is the helical spring 16a. The overall lower-shaft synchronizing and locking mechanism and structures that are associated with the feed-dogs 14a' and 14b', are represented generally as structures 3a and 3b, respectively, for the first sewing head 1a, and for the second sewing head 1b. The synchronizing mechanisms 25a and 25b have associated slot-containing synchronizing lock-wheels 15c, and 15d respectively having lock-slots 17a' and 17b' respectively, corresponding and analagous to lock-wheels 15a and 15b. The symbolic synchronizing mechanisms 25a and 25b additionally include mechanism such as conventional synchronizing gears and assorted conventional mechanism symbolically represented as 17c and 17d that function integrally with the eccentric lock-wheels 15a, 15b, 15c and 15d. The symbolic mechanisms 25a and 25b additionally each include elements comparable to 15b'–16b, and 15a'–16a.

For each of the sewing head assemblies 1a and 1b, there is the conventional foot mechanism and structures thereof, conventionally known as alternating presser foot arrangement, symbolically represented as above-described foot plates 14a and 14b respectively with associated conventional above-described feed-dog mechanisms 14a' and 14b'.

While there may be multiple heads mounted in association with one lower shaft such as shaft 20a, the critical maximum lengths permissible for each of the shafts 20a and shaft 20b, and preferably also for the needle-driven shafts 9a' and 9b', are typically each about gauges 15 to 20 inches, the cummulative effective length may be from about gauge twenty inches to unlimited maximum, typically about 24 inches. Beyond the individual maximum gauge-lengths, problems and difficulties of the types described above for the prior art are encountered, requiring the present invention's dual belt drives by the spaced-apart belts, and concurrently requiring the synchronizing structures and mechanism above-described.

In such arrangement, it is critical that the separate feed-dog drive-shafts 20a and 20b, and more-preferably also the separate needle drive-shafts 9a' and 9b', be coordinately synchronized intermittently to assure that the reciprocating needles 13a and 13b are in precise synchronization with their alternating feed dogs 14a' and 14b', to avoid the machine self-destructing or jamming or the like. All of the corresponding solenoid locks of the corresponding eccentric wheels such as 15a and 15b, are concurrently locked into position while the shafts 20a and 20b are thereafter turned-back to a predetermined zero-position, whereby all corresponding eccentrics are thereby synchronized. Thereafter, the locks are disengaged concurrently—this being conventional technology, but essential to the present novel machine.

There is a convention-type switch 24 and on-off lever 24a or button thereof for alternately turning on and off drive motor 4, by making or breaking electrical circuitry typically for plug 27b. Likewise, diagrammatically, the solenoid switch 26 has a power cord and diagrammatically a plug 27a for tapping an electrical source, whereby the solenoids are activable by current-carrying cords 30a through 30d by corresponding manual switches 26a through 26d.

Instead of the preferred solenoid mechanism noted-above, other lock-activating and deactivating mechanisms may be substituted—such as conventional pneumatic (air) cylinder(s) and/or conventional mechanical mechanism(s) notoreously known in the prior art.

It is within the scope of this invention to make such variations and modifications as are apparent to a person of ordinary skill.

I claim:

1. A multi-needle walking-foot chain stitch sewing machine with sewing heads including alternating presser feet, synchronized reciprocatable needles and needle-reciprocation mechanisms thereof, and feed-dogs and feed dog reciprocation-mechanisms thereof, the improvement comprising in combination: (1) support structure, (2) spaced-apart sewing heads mounted on said support structure, the spaced-apart sewing heads including at-least separate laterally spaced-apart first and second needle-reciprocating means for reciprocating needles, the spaced-apart sewing heads including at-least third and fourth spaced-apart first and second feed-dogs-reciprocation means for reciprocating feed dogs, (3) an upper primary drive-shaft, (4) secondary lower first and second drive means for driving said first and second needle-reciprocation means, and secondary lower third and fourth drive means for driving said first and second feed-dogs-reciprocation means, each of said first, second, third and fourth drive means including a drive shaft having a maximum length of about sixteen inches, (5) separate first and second wheel synchronizer means mounted on said support structure, one of the first and second wheel synchronizer means being driven by one of said first and second drive means through said drive shaft thereof, and a remaining other of said first and second wheel synchronizer means being driven by a remaining other one of said first and second drive means through said drive shaft thereof, one of said first and second wheel synchronizer means driving one of said first and second needle-reciprocation means, and a remaining other one of said first and second wheel synchronizer means driving a remaining other one of said first and second needle-reciprocation means, (6) separate third and fourth wheel synchronizer means mounted on said support structure, one of said third and fourth synchronizer means being driven by one of third and fourth drive means through said drive shaft thereof and a remaining other one of said third and fourth wheel synchronizer means being driven by a remaining other one of said third and fourth drive means through said drive shaft thereof, one of said third and fourth synchronizer means driving one of said third and fourth feed-dog-reciprocation means, and a remaining other one of said third and fourth synchronizer means driving a remaining other one of said third and fourth feed-dog-reciprocation means, and (7) synchronizer activation and deactivation means for alternately initiating and deactivating concurrently at-least two of said first, second, third and fourth synchronizer means for synchronization of at-least one of said first needle-reciprocation means with said third feed-dog-reciprocation means and said second needle-reciprocation means with said fourth feed-dog-reciprocation means.

2. A multi-needle walking-foot chain stitch sewing machine of claim 1, in which said first synchronizer means including a first eccentric wheel through which said first needle-reciprocation means is driven, in which said second synchronizer means includes a second eccentric wheel through which said second needle-reciprocation means is driven, in which said third synchronizer means includes a third eccentric wheel through which said third feed-dog-reciprocation means is driven, and in said fourth synchronizer means includes a fourth eccentric wheel through which said fourth feed-dog-reciprocation means is driven.

3. A multi-needle walking-foot chain stitch sewing machine of claim 2, in which said synchronization activation and deactivation means includes a first solenoid lock means for alternately locking and releasing said first eccentric wheel when said synchronization activation and deactivation means is alternately activatable and deactivatable for said first synchronizer means, and further includes a second solenoid lock means for alternately locking and releasing said second eccentric wheel when said synchronization and activation means is alternately activatable and deactivatable for said second synchronizer means, and further includes a third solenoid lock means for alternately locking and releasing said third eccentric wheel when said syncronizaton and activation means is alternately activatable and deacivatable for said third synchronizer means, and further includes a fourth solenoid lock means for alternately locking and releasing said fourth eccentric wheel when said synchronization and activation means is alternately activatable and deactivatable for said fourth synchronizer means.

4. In a multi-needle walking-foot chain stitch sewing machine of claim 3, in which said synchronization activation and deactivation means is further for concurrent and simultaneous alternate activation and deactivation of all of said first, second, third and fourth solenoid lock means.

* * * * *